US008807048B2

(12) United States Patent
Ivanov et al.

(10) Patent No.: US 8,807,048 B2
(45) Date of Patent: Aug. 19, 2014

(54) TRIPLE RAIL PRT TRANSPORTATION SYSTEM

(75) Inventors: Valentin Hristov Ivanov, Walpole, MA (US); Daniel Valentinov Ivanov, Walpole, MA (US)

(73) Assignees: Valentin Ivanov, Walpole, MA (US); Daniel Ivanov, Walpole, MA (US)

( * ) Notice: Subject to any disclaimer, the term of this patent is extended or adjusted under 35 U.S.C. 154(b) by 65 days.

(21) Appl. No.: 13/459,111

(22) Filed: Apr. 28, 2012

(65) Prior Publication Data

US 2013/0289861 A1 Oct. 31, 2013

(51) Int. Cl.

| | |
|---|---|
| ***B61B 13/04*** | (2006.01) |
| ***B61C 13/00*** | (2006.01) |
| ***E01B 25/00*** | (2006.01) |

(52) U.S. Cl.

CPC ..... *B61B 13/04* (2013.01); *E01B 25/00* (2013.01)

USPC ..... 105/141; 105/146; 104/118; 104/121; 701/19

(58) Field of Classification Search

None

See application file for complete search history.

(56) References Cited

U.S. PATENT DOCUMENTS

| | | | | |
|---|---|---|---|---|
| 832,319 | A * | 10/1906 | Humphrey | 105/147 |
| 891,416 | A * | 6/1908 | Fenyo | 104/121 |
| 3,225,704 | A * | 12/1965 | Gilvar et al. | 104/121 |
| 3,882,786 | A * | 5/1975 | Woligrocki | 104/89 |
| 4,588,150 | A * | 5/1986 | Bock et al. | 244/172.4 |
| 5,794,535 | A * | 8/1998 | Pardes | 104/130.07 |
| 6,575,100 | B2 * | 6/2003 | Faucher et al. | 104/126 |
| 6,672,223 | B1 * | 1/2004 | Date | 105/147 |
| 6,969,030 | B1 * | 11/2005 | Jones et al. | 244/172.5 |
| 8,096,387 | B2 * | 1/2012 | Kattainen et al. | 187/248 |
| 2003/0140817 | A1 * | 7/2003 | Novacek | 104/137 |
| 2008/0173209 | A1 * | 7/2008 | Lechner | 104/118 |
| 2009/0101040 | A1 * | 4/2009 | Yang | 104/138.1 |
| 2011/0218697 | A1 * | 9/2011 | Goldberg | 701/19 |
| 2012/0055367 | A1 * | 3/2012 | Zayas | 104/88.01 |
| 2012/0152659 | A1 * | 6/2012 | Husmann et al. | 187/373 |
| 2014/0090575 | A1 * | 4/2014 | Nagamine et al. | 104/91 |
| 2014/0116282 | A1 * | 5/2014 | Horihan | 104/89 |

OTHER PUBLICATIONS

Lee, Hong-Hee, and Ui-Hurn Jeong. "A study on speed synchronization for multi-motors using controller area network." Science and Technology, 2000. KORUS 2000. Proceedings. The 4th Korea-Russia International Symposium on. vol. 2. IEEE, 2000.*

Gerlach, Sebastian, Basile Schaeli, and Roger D. Hersch. "Fault-Tolerant Parallel Applications with Dynamic Parallel Schedules: A Programmer's Perspective." Dependable Systems: Software, Computing, Networks. Springer Berlin Heidelberg, 2006. 195-210.*

* cited by examiner

*Primary Examiner* — Helal A Algahaim
*Assistant Examiner* — Paul Castro

(57) ABSTRACT

A personal rapid transit (PRT) system that comprises a very economic triple rail topology for bi-directional urban personal transport. All the ramps are implemented always on the one side of the tracks for the sake of the narrow urban spaces accommodation. In order to achieve fast speed direction changes and a non compromised passenger security, the ramps are implemented as parallel lines to the corresponding tracks, and the vehicles do not use any wheel steering or electromagnetic heads. Instead, a landing wheel gear is implemented, and all the wheels are synchronized by speed before touching the rails. The vehicle's center of masses is constantly maintained to be found in most cases in one plain with the guideways. In case of emergencies, a special "anti-fall down" security system keeps the vehicle on the rails. The vehicles are capable of making all kind of turns by utilizing the highly compact Direction Change Connector. The PRT control system is implemented as three layer hierarchical system that consists of fault-tolerant processor nodes only, and utilizes two channel (with a hot reserve) wireless communications between the layers.

6 Claims, 7 Drawing Sheets

TRIPLE RAIL PRT TRANSPORTATION SYSTEM

BACKGROUND OF THE INVENTION

The present invention is in the technical field of urban transportation systems. More particularly, the present invention is in the technical field of Personal Rapid Transit (PRT) systems.

The existing transportation systems for public utilization are known for their high energy consumption, air pollution caused, frequent stops, and the inconvenience to change the transportation vehicles along the route.

From the other hand, the idea of personal cars that travel non-stop from the start to the destination location (PRT) attracts more and more attention.

Most of these systems are intended to accommodate a small group of passengers, the others tend to be too wide in size and are not suitable for the narrow urban spaces.

Additionally, their route switching methods require wheels steering which demands slow downs during the direction changes.

Also, most PRT vehicles do not maintain a proper position of their center of the mass that jeopardizes the passenger security on high speeds.

Finally, there is not known a PRT traffic control system based totally on a fault-tolerant processor nodes that are subsequently incorporated in a hierarchical totally fault-tolerant layered architecture.

The inventors studied thoroughly numerous patents that are closely related to the invention and implementation of PRT transportation systems. Among them are:

United States Patents

U.S. Pat. No. 564,369 Farnham—Jul. 21, 1896
U.S. Pat. No. 925,106 Kearney—Jun. 15, 1909
U.S. Pat. No. 1,238,276 Dickson—Aug. 28, 1917
U.S. Pat. No. 1,379,614 Bennington—May 31, 1921
U.S. Pat. No. 3,118,392 Zimmermann—Jan. 21, 1964
U.S. Pat. No. 3,225,704 Gilvar—Dec. 28, 1965
U.S. Pat. No. 3,238,894 Maksim—Mar. 8, 1966
U.S. Pat. No. 3,618,531 Eichholtz—Nov. 9, 1971
U.S. Pat. No. 3,675,584 Hall—Jul. 11, 1972
U.S. Pat. No. 4,000,700 Hannover—Jan. 4, 1977
U.S. Pat. No. 4,841,871 Leibowitz—Jun. 27, 1989
U.S. Pat. No. 6,318,274 Park—Nov. 20, 2001
U.S. Pat. No. 6,651,566 Stephan—Nov. 25, 2003
U.S. Pat. No. 6,971,318 Coakley—Dec. 6, 2005

Foreign Patents

WO 95/35221 Kim—Dec. 28, 1995
CA 2,604,510 Nanzheng—Oct. 19, 2006
WO 2007/013991 A2 Clark—Feb. 1, 2007

SUMMARY OF THE INVENTION

The present invention comprises a compact 3-rail system that provides for 2 track bi-directional transport where the cars change the direction at maximum speed using the new parallel ramp architecture. Also, the cars implement a center of the mass dynamic alignment, as well as a special security mechanism that prevents them from falling down off the tracks.

The invented here new topology assumes all the ramps situated on one side of the system only, and a special Direction Change Connector that consists of two 90-degree sectors provides for all types of turns.

The proposed highly reliable system control architecture implies a total fault-tolerance i.e. every point of processor control consists of an odd number of processors that work simultaneously on same tasks, and the final decisions are taken by voting.

DETAILED DESCRIPTION OF THE INVENTION

Figure 1:
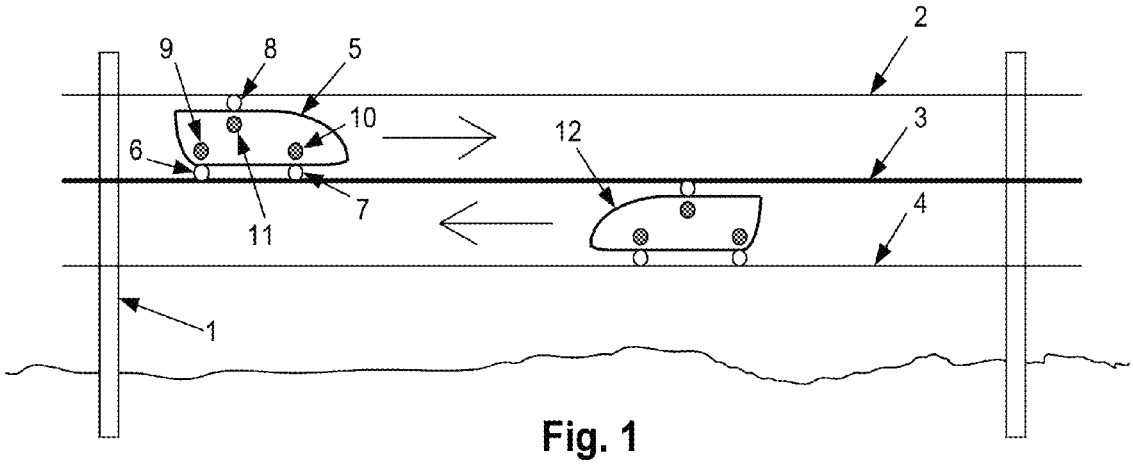
FIG. 1 is a perspective view of the Triple Rail system showing two sample vehicles.
Figure 2A:
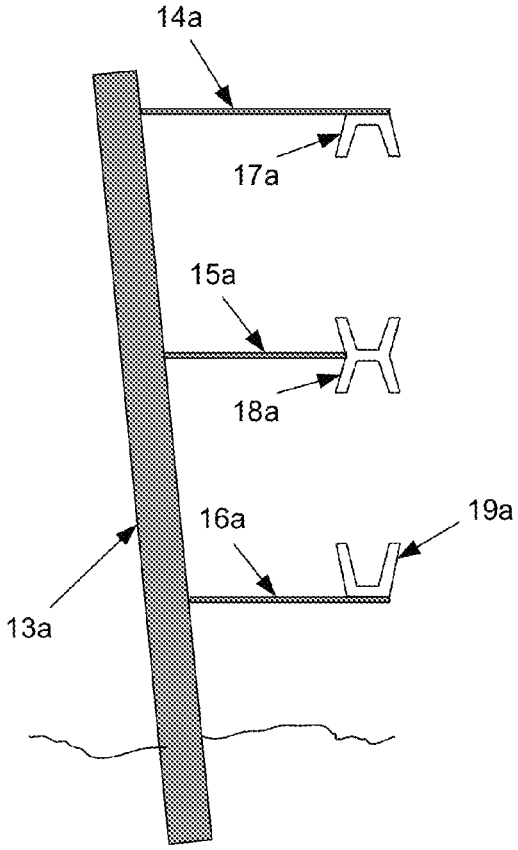
FIG. 2*a* shows a cross-sectional view of the system where the rails shape is demonstrated.

Referring now to the invention in more detail, in FIG. 1 we see the general outlook of the transportation system topology where the plurality of pedestals 1 supports the upper rail 2, the middle rail 3 and the lower rail 4. The vehicle 5 and the vehicle 12 show one and the same type of vehicle moving in the opposite directions. Every vehicle is equipped with two sets of wheels. The wheels 6, 7 and 8 belong to a vertically movable landing platform and implement the STRAIGHT direction motion, while the wheels 9, 10 and 11 belong to another vertically moving landing platform and implement the TURIN motion. FIG. 2*a* shows a cross-sectional view of the transportation system where the plurality of pedestals 13*a* supports the rails 17*a*, 18*a*, and 19*a* by using the horizontal supporting profiles 14*a*, 15*a*, and 16*a*. All the pedestals are tilted backwards to an angle of (90+ alpha) degrees with respect to the horizontal axis, and in the cross-section plain, in order to act as a counterweight. The rail 17*a* is the upper rail and comprises turned upside-down widened V-profile, the rail 18*a* is the middle rail and comprises a widened X-profile, and the rail 19*a* is the lower rail and comprises a widened V-profile.

Figure 2B:
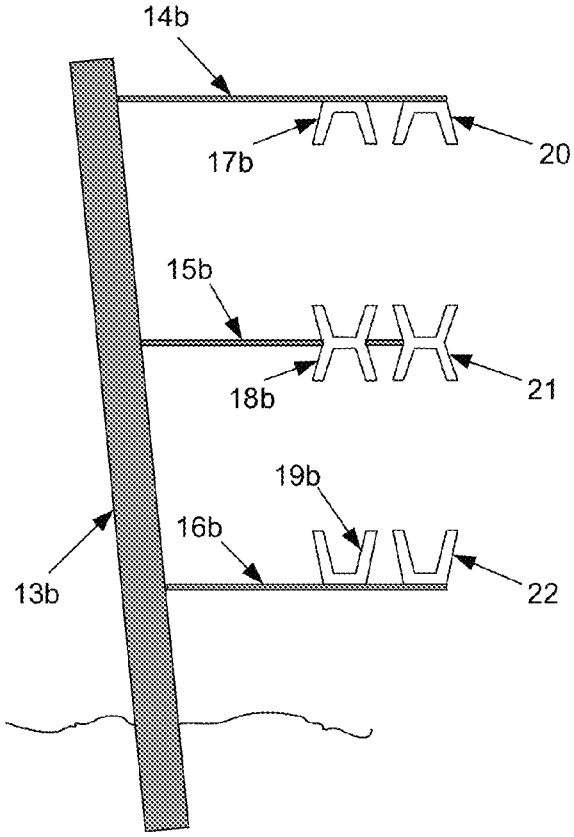
FIG. 2*b* shows a cross-sectional view of the system at the ramps.

FIG. 2*b* shows the same pedestal 13*b* as in FIG. 2*a*, as well as the same rails 17*b*, 18*b*, 19*b*, and the same horizontal supporting profiles 14*b*, 15*b* and 16*b* but, in addition, it shows one of the main features of the present invention—the parallel ramp rails 20, 21 and 22 which are exactly the same as rails 17*b*, 18*b* and 19*b*. The rails 20, 21 and 22 implement the introduced here PARALLEL RAMP which allows for direction change without generating of any centrifugal or centripetal forces. The latter makes the fast speed direction changes very secure. In order to avoid any water or melting ice on the rails, they are properly punched at the production lines.

Figure 3:
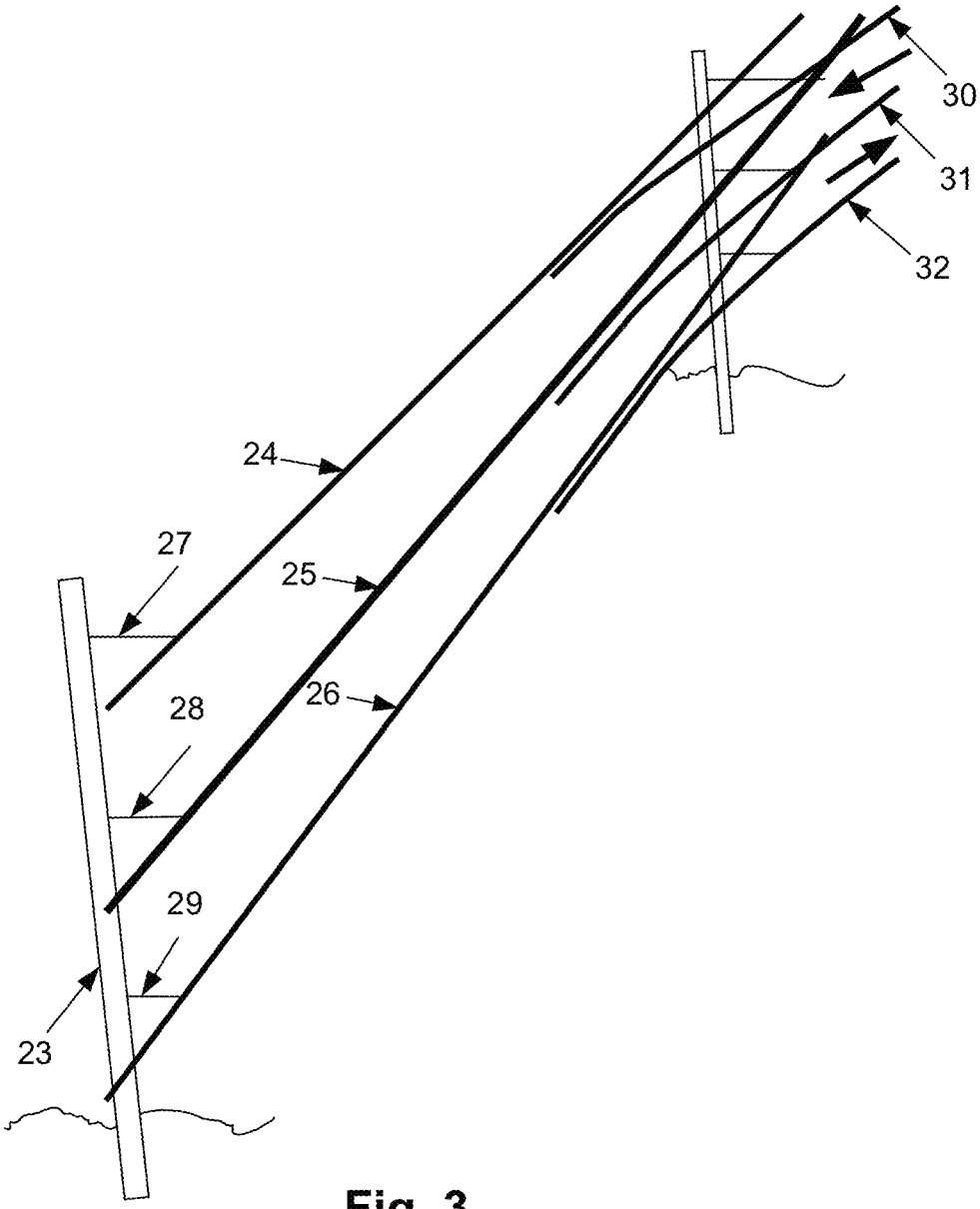
FIG. 3 is a perspective view of the system that shows the pedestals tilt and the parallel ramps.

FIG. 3 shows a perspective view of the proposed transportation system where the plurality of pedestals 23 supports the upper rails 24, the middle rails 25, and the lower rails 26 but it also shows the parallel ramp rails 30, 31 and 32. Here we can see that the ramp rails stay parallel to their corresponding base rails for certain amount of distance, and then they bend. In order to accommodate this transportation system in the narrow urban spaces, the ramps are always located on the one side only i.e. either only on the left side or on the right side only.

Figure 4:
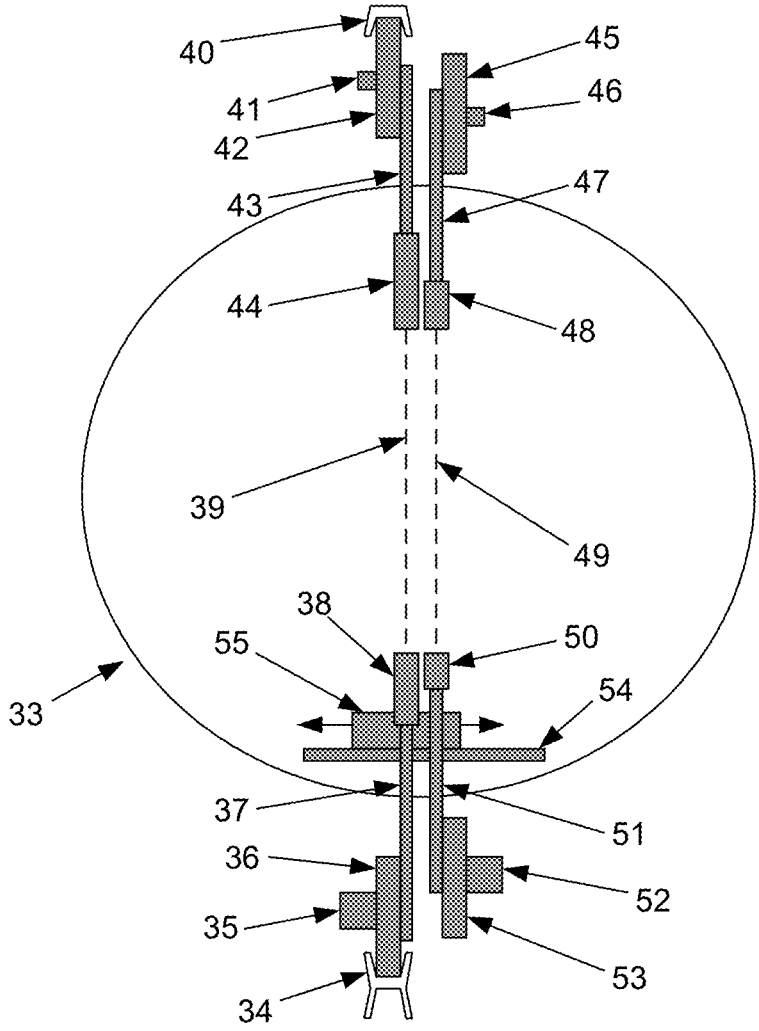
FIG. 4 shows a cross-section of the vehicle that illustrates the ramp landing gear, and the center of the mass balance mechanism.

FIG. 4 shows a cross-sectional view of the vehicle 33, and two identical vertically moving landing platforms 39 and 49 are depicted. The landing platform 39 is propelling the vehicle in the so called here STRAIGHT mode, and the landing platform 49 is propelling the vehicle in the so called here TURN mode. When taking turns, both the platforms position their wheels into the rails, and when the parallel part of the ramp ends, the STRAIGHT platform detaches its wheels from the STRAIGHT rail leaving the vehicle to propel using platform 49 only. Every landing platform incorporates two lower wheels of type 36 named front lower wheel and rear lower wheel, and one upper wheel of type 42. This figure depicts the rear lower wheels only. The rails 34 and 40 act as guideways for the lower wheels 36 and the upper wheel 42. The main electrical motor 35 drives the vehicle and is installed on the rear lower wheel only. The electrical motor installed on the front lower wheel and the electrical motor 41 installed on the upper wheel implement a linear velocity synchronization for those wheels. The linear actuators 38 and 44 move the landing axles 37 and 43 simultaneously to-the-rails or off-the-rails attaching or detaching the wheels this way to the rails. The TURN platform is identical to the STRAIGHT one, and the following mapping of parts is true: 35-52, 36-53, 37-51, 38-50, 44-48, 43-47, 42-45, 41-46. Another new module disclosed in this invention is the center of the mass dynamic control implemented by the balancing table 54, and the balancing load 55. If the vehicle inclines even slightly or the passenger moves inside, a special sensor rolls the balancing load to the right or to the left, so the center of the mass keeps staying in one and the same plane with the guideways.

Figure 5:
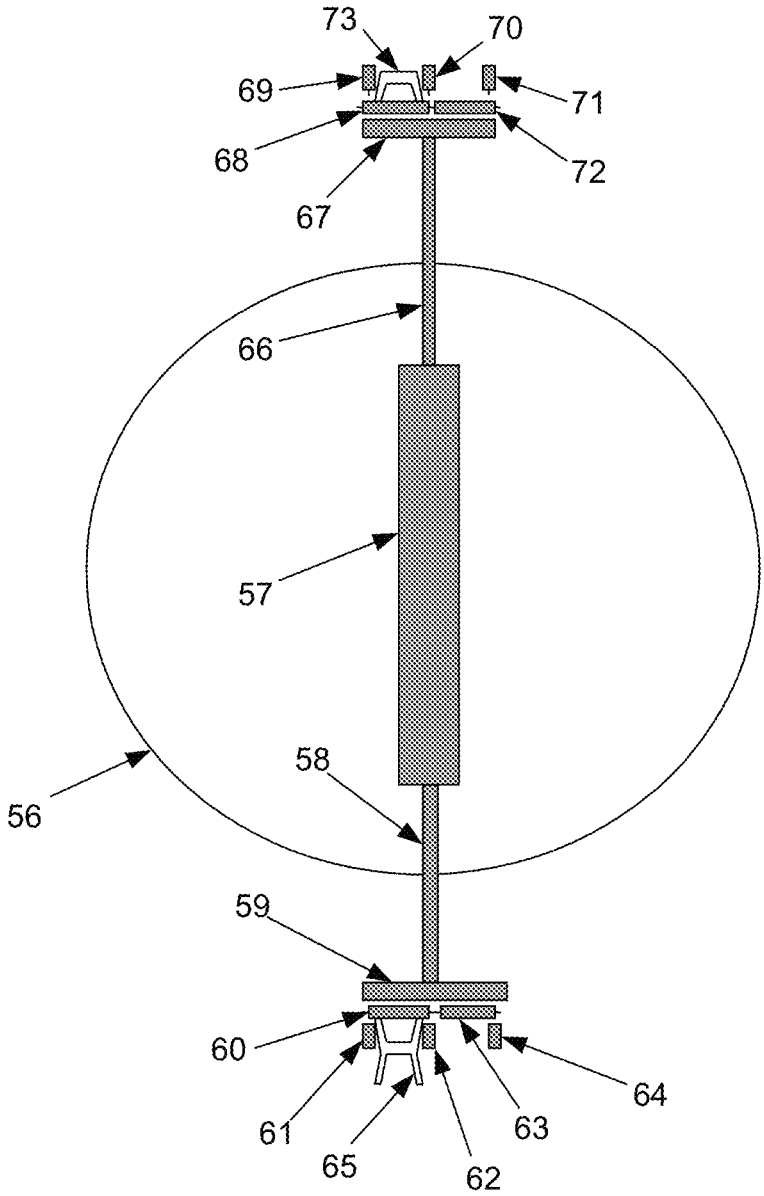
FIG. 5 shows a cross-section of the personal vehicle, and reveals the retractable security mechanism.

FIG. 5 shows another cross-sectional view of the vehicle 56 where the ANTI-FALL DOWN security system is revealed. If the 3D space position of the vehicle exceeds some limits, or if the electrical contact with the rails is lost, the security system lets the safety cylinder 57 to extend immediately two W-shaped arms that consist of the retractable axles 58 and 66, base supports 59 and 67, as well as of embracing rollers 60, 61, 62, 63, 64 that embrace the rail 65 (and the adjacent ramp rail if being on the ramp), and the embracing rollers 68, 69, 70, 71, 72 that embrace the rail 73 (and the adjacent ramp rail if being on the ramp). This approach keeps the arms hidden in the vehicle and greatly reduces the air resistance on high operating speeds.

Figure 6:
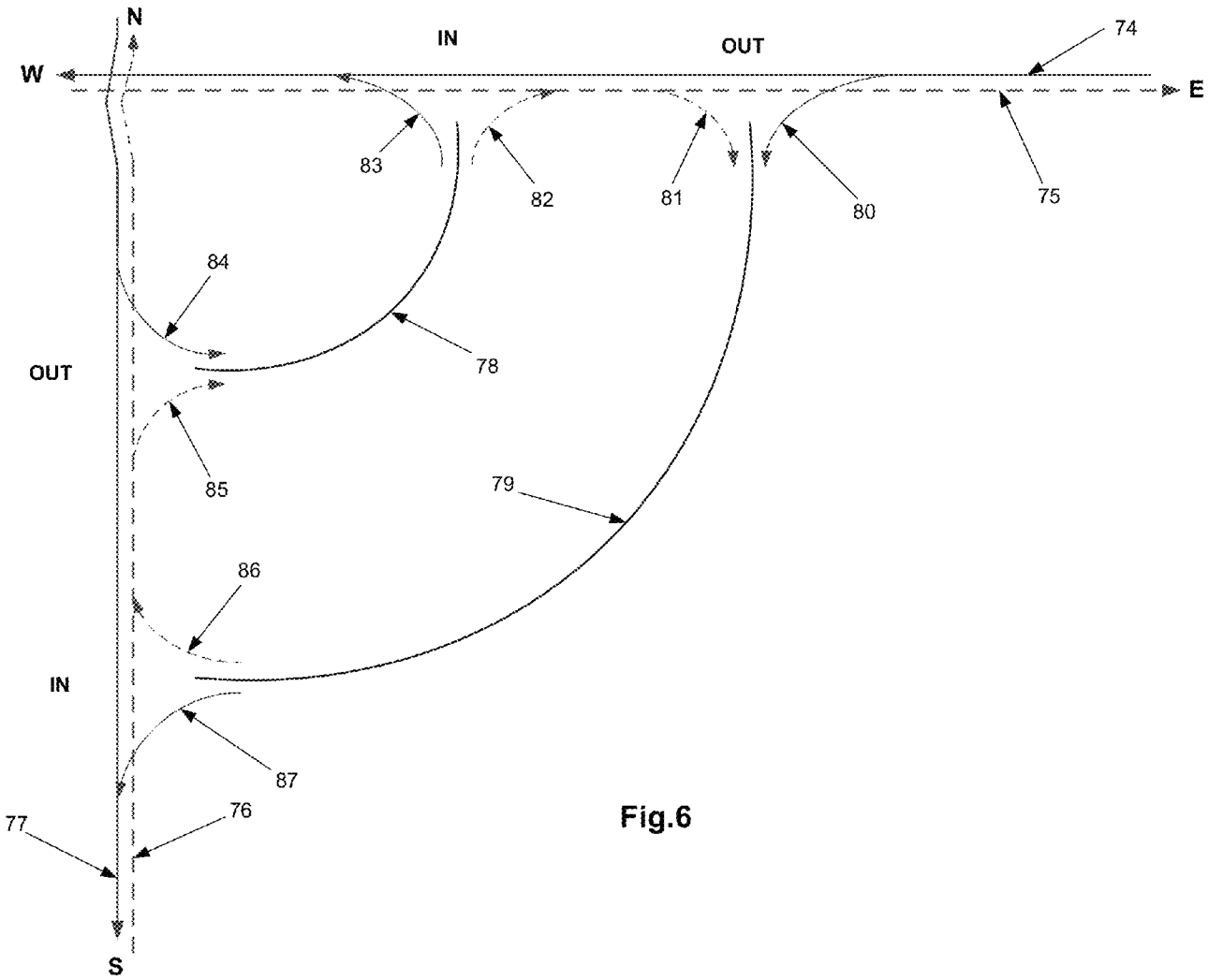
FIG. 6 illustrates the new Direction Change Connector that allows for any type of direction changes.

FIG. 6 shows another important innovation—the Direction Change Connector (DCC) that comprises two concentric 90 degree sectors, and this compact solution allows for all kind of turns. Here we call "upper track" the combinations 74, 77 of the upper and the middle rail, and we call "lower track" the combinations 75, 76 of middle and lower rail. The smaller sector is denoted as 78, and the larger as 79. The guideway arches 80 and 81 implement the output of tracks 74 and 75 to the DCC. The guideway arches 82 and 83 implement the input to the tracks 74 and 75 from the DCC. The guideway arches 84 and 85 implement the output of tracks 76 and 77 to the DCC. The guideway arches 86 and 87 implement the input to the tracks 76 and 77 from the DCC. Based on this very compact design, each track can make left, right, and U-turn.

Figure 7:
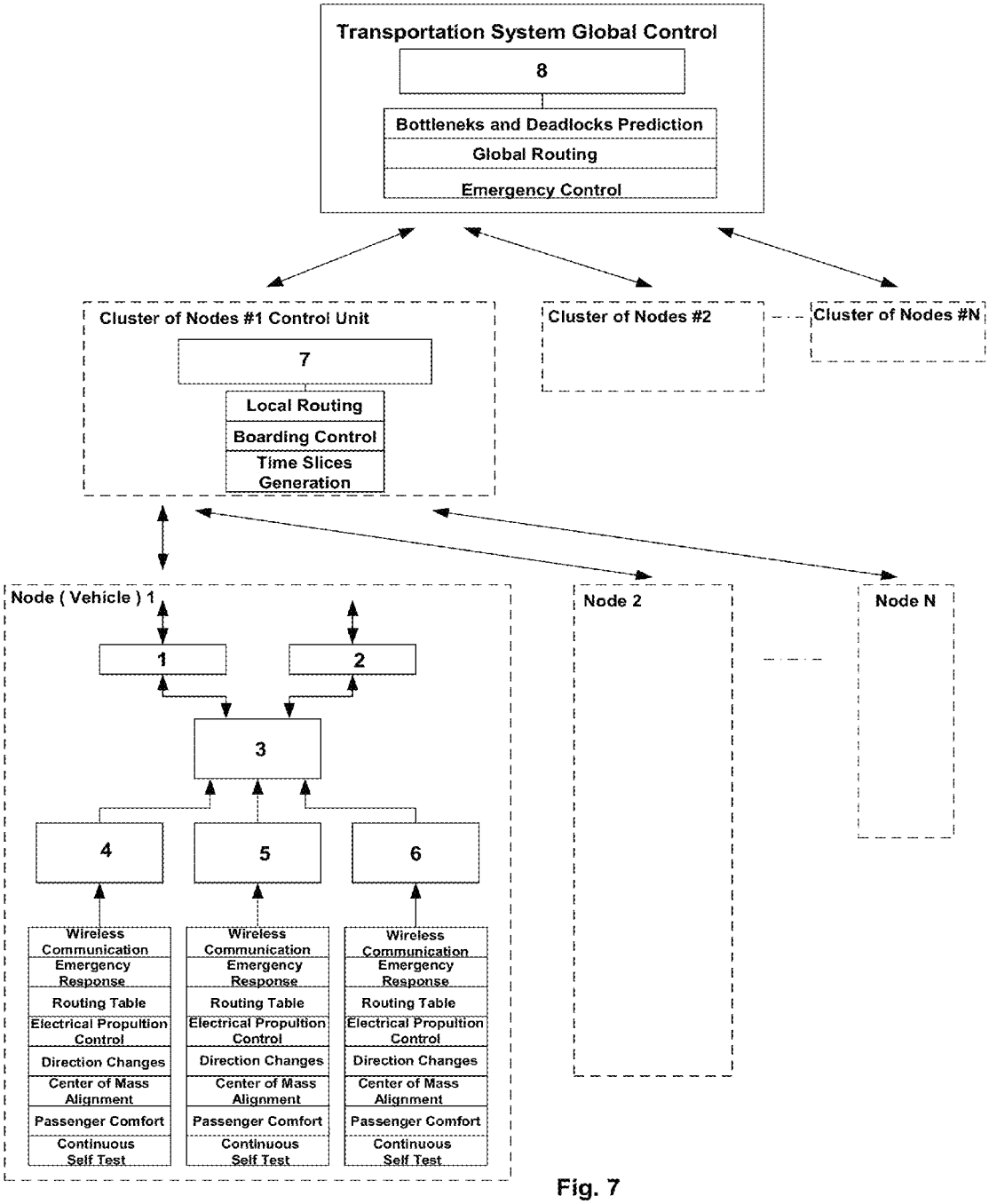
FIG. 7 reveals the three layer hierarchical totally fault-tolerant control system.

FIG. 7 reveals the architecture of the PRT control system that consists of three levels—Vehicle Nodes, Clustered Nodes, and Global Control. The Vehicle Nodes are based on an odd number of processors 4, 5 and 6 which work simultaneously on same tasks such as Wireless Communications, Emergency Response, Routing Table Execution, Electrical Propulsion Control, Direction Changes, Center of Mass Alignment, Passenger Comfort, Continuous Self Test etc. All the decisions are taken by voting implemented in the arbiter 3. The basic wireless communication module 1 and the spare wireless communication module 2 perform the dialog communications with the next higher layer of the architecture—the Clustered Nodes. Every node of the Clustered Nodes layer consists of fault-tolerance processors block 7 that is identical to the blocks 3, 4, 5, and 6 in the Vehicle Nodes. A "cluster" is defined here as any current amount of vehicles situated on two adjacent stations and on the tracks between them. Thus, cluster #1 may include the vehicles on Station 1, Station and the ones between them, cluster #2 may include the vehicles on Station 2, Station 3 and the ones between them etc. Obviously, any cluster is overlapped by its adjacent neighbors, so every station is processed by two cluster nodes. The clustered nodes run the following, basic tasks simultaneously: Local Routing, Boarding Control, Time Slices Generation etc. The Time Slicing mechanism suggested in this invention implies building the key-value pairs for every vehicle where the key represents the vehicle ID, and the value determines what time a particular vehicle must be found on any common part of the track. In other words, if we take a ten foot long part of the tracks and mark it as A-B, at the relative time 1 the vehicle with Time Slice=1 will be found on A-B, then at the relative time 2 the vehicle with Time Slice=2 will be found on A-B an so forth. This way we put in order the vehicles when they enter or leave the ramps. The Clustered Nodes communicates with the Global Control layer using the same two blocks wireless communication module as 1 and 2 in the Vehicle Nodes. The Global Control layer consists of massive farm of fault-tolerant processors that may reach 9 or more processors working in parallel, as well as 3 arbiters. The main tasks implemented in parallel are Bottleneck and Deadlock Prediction, Global Routing, Emergency Control etc.

We claim:

1. A personal rapid transportation (PRT) system that comprises a first and second set of rails on which a plurality of moving units run on a first and second set of wheels where the first set of rails consists of three rails aligned in a vertical plane further comprising an upper rail, a middle rail, and lower rail, wherein the upper rail and the middle rail form an upper track, and the middle rail and the lower rail form a lower track; and the second set of rails implementing a ramp and located on only one side of the first set of rails consisting of three rails aligned in a second vertical plane which is parallel to the first vertical plane and consisting of an upper ramp rail, a middle ramp rail, and lower ramp rail, wherein the upper ramp rail and the middle ramp rail form an upper ramp track, and the middle ramp rail and the lower ramp rail form a lower ramp track; and before reaching the lower ramp track, the moving units run on the first set of wheels on the lower track of the first set of rails, then at the beginning of the ramp the moving units engage gradually the second set of wheels to the lower ramp track that is a part the second set of rails, and before the parallel part of the above vertical planes ends, the first set of wheels is gradually disengaged from the lower track of the first set of rails and the moving units now run on the lower ramp track that is part of the second set of rails where the lower ramp track that is part of the second set of rails curves gradually away from the first vertical plane where the lower track of the first set of rails is located; and when coming from the upper ramp track that is a part of the second set of rails the moving units run on the second set of wheels on the upper ramp track that is part of the second set of rails, then at the beginning of the part where both the vertical planes are parallel the moving units engage gradually the first set of wheels to the upper track that is a part the first set of rails, and before the parallel part of the above vertical planes ends, the second set of wheels is gradually disengaged from the upper ramp track which is a part of the second set of rails and the moving units now run on the upper track that is part of the first set of rails.

2. The PRT transportation system as defined in claim 1, where the moving units are equipped with two identical propelling systems that contain three wheels each and are called landing platforms, where both the landing platforms implement straight or direction change motion interchangeably, and the landing platforms become engaged to the tracks by gradually moving the single upper wheel to the rail above it and gradually moving the two lower wheels towards the rail underneath them until all the three wheels will engage the rails simultaneously; and before reaching the ramp only one landing platform is engaged to its track and from the beginning of the ramp area the second landing platform gets engaged to the ramp track and from this moment both the landing platforms propel the moving unit until a security check is done, and then the first landing platform is gradually disengaged before the end of parallel part of the above-mentioned planes is reached where for each of the landing platforms one of the lower wheels propels the moving unit by means of a DC motor, and the other two wheels touch the tracks accelerated by means of synchronization motors.

3. The PRT transportation system as defined in claim 1 in which all the moving units implement a center of the mass dynamic alignment by means of a movable balancing load that shifts along the line perpendicular to the direction of motion and keeps the center of the mass situated within the vertical plane of the tracks.

4. The PRT transportation system as defined in claim 1 in which all the moving units are equipped with a safety environment against falling down, and this equipment comprises two vertically extendable arms that come out from the moving unit and stretch until the upper and lower rail of the track where they embrace the tracks and keep the moving unit on the tracks.

5. The PRT transportation system as defined in claim 1 in which the direction changes are made possible by utilization of a direction change connector that comprises a system of two sectors of two concentric circles which sectors occupy 90 degrees of the circles, and geometrically look like pieces of circles in quadrant IV of a Cartesian Coordinate System, where the abscissa and ordinate axes of the abovementioned Cartesian Coordinate System represent two perpendicular PRT bi-directional tracks, and the entries and exits to and from tracks are implemented by eight arches situated as two per every beginning and another two per every end of the above sectors.

6. The PRT transportation system as defined in claim 1 in which the moving units control is implemented as three layer hierarchical system where the lowest layer comprises plurality of nodes, one per moving unit, and the said nodes are designed in fault-tolerant architecture utilizing an odd number of processors that implement a local control e.g. center of mass alignment, and the middle layer defines a cluster of nodes as the nodes stationed at two adjacent stations plus the nodes between the stations where the middle layer implements tasks e.g. time-slice generation meaning assigning a time duration to each moving unit when only that unit can appear at any particular coordinates on the tracks, and the highest layer of the system is the global arbiter and high level bottlenecks and deadlocks predictor and estimator.

* * * * *